US009646580B1

(12) United States Patent
Lee

(10) Patent No.: US 9,646,580 B1
(45) Date of Patent: May 9, 2017

(54) DECORATIVE PANEL FOR GUITAR AND MANUFACTURING METHOD THEREOF

(71) Applicant: Se Kang Lee, Incheon (KR)

(72) Inventor: Se Kang Lee, Incheon (KR)

( * ) Notice: Subject to any disclaimer, the term of this patent is extended or adjusted under 35 U.S.C. 154(b) by 0 days.

(21) Appl. No.: 15/360,680

(22) Filed: Nov. 23, 2016

(30) Foreign Application Priority Data

Feb. 29, 2016 (KR) ..... 10-2016-0024373

(51) Int. Cl.
*G10D 1/08* (2006.01)

(52) U.S. Cl.
CPC ..... *G10D 1/08* (2013.01)

(58) Field of Classification Search
CPC ..... G10D 1/08
See application file for complete search history.

(56) References Cited

U.S. PATENT DOCUMENTS 6,395,968 B1 * 5/2002 Minakuchi ..... G10D 1/00 84/290
7,705,224 B1 * 4/2010 Ward ..... G10D 1/08 84/267
7,893,330 B1 * 2/2011 Andreasen ..... G10D 1/085 84/291
2005/0241456 A1 * 11/2005 Nakamura ..... G10D 1/08 84/322
2012/0272808 A1 * 11/2012 Kim ..... G10D 3/02 84/291

FOREIGN PATENT DOCUMENTS

KR 10-0336707 B1 5/2002

* cited by examiner

*Primary Examiner* — Robert W Horn
(74) *Attorney, Agent, or Firm* — Im IP Law; C. Andrew Im

(57) ABSTRACT

A decorative panel for a guitar and a manufacturing method of the decorative panel. The decorative panel can be applied to a head, a body, a neck or a pick guard of the guitar to enhance an aesthetic sense of the guitar. The manufacturing process is simplified to reduce the manufacturing period thereby increasing productivity and reducing the failure rate of the guitar. The decorative panel for the guitar includes a base plate; and a binding disposed at the edge of the base plate in a band type by a binding line. The binding line is integrally formed such that one or more binding grooves formed on the periphery of the base plate are filled with epoxy resin paint.

4 Claims, 6 Drawing Sheets

DECORATIVE PANEL FOR GUITAR AND MANUFACTURING METHOD THEREOF

RELATED APPLICATIONS

This application claims priority from Korean Patent Application No. 10-2016-0024373 filed Feb. 29, 2016, which is incorporated herein by reference in its entirety.

FIELD OF THE INVENTION

The present invention relates to a decorative panel for a guitar and a manufacturing method of the decorative panel, which can enhance an aesthetic sense of the guitar because the decorative panel can be applied to a head, a body, a neck or a pick guard of the guitar, which can simplify the manufacturing process and remarkably reduce the manufacturing period of time so as to increase productivity of the guitar, and which can considerably reduce a failure rate of the guitar.

BACKGROUND OF THE INVENTION

In general, a guitar is a sort of plucked string instruments which make sounds when a user plucks the strings with the fingers. Nowadays, there are various kinds of guitars, such as acoustic guitars, electric guitars, base guitars and so on, according to the number of strings and structures to make sounds. The guitar generally includes a body, a neck and a head. The neck has a finger board, and strings which cross the head, the neck and the finger board are arranged on the neck.

Because various design elements including various forms, colors, marks, images and ornaments are applied to such a guitar, it may serve as a selection element for purchase guitars to guitar players or greatly serve as a performance art element to viewers. Such design elements and various manufacturing methods for applying the design elements to guitars have been developed.

A binding line, which is formed surrounding the body periphery of a guitar, out of the design elements is formed through the steps of forming a stepped jaw along the body periphery, inserting a top purfling and a side purfling into the stepped jaw according to their positions and inserting a binding band between the top purfling and the side purfling.

In relation with the above technique, Korean Patent No. 10-0336707 discloses a guitar body and method for manufacturing the same. The method for manufacturing a guitar body includes the steps of: forming a binding groove at the periphery of a front panel and the periphery of an acoustic opening of a guitar body or at a part needing a pattern; burying and binding a binding cell formed of a plurality of arrayed and layered ABS resin bands, which are colorless or have various colors, on the binding groove; grinding the surface of the body where the binding cell is buried, forming an adhesive layer on a hologram sheet of 100 μm and adhering the hologram sheet onto the pattern section of the binding cell after cutting a unnecessary part; repeatedly painting the surface of the guitar body on which the hologram sheet is adhered several times; grinding the surface of the guitar body dried after the above painting step, and repeatedly painting the surface; and grinding the surface of the guitar body dried after the painting step, and performing a polishing process.

However, because the conventional manufacturing method carries out lots of complicated processes in order to form one binding line on the guitar, the conventional manufacturing method has several disadvantages in that it is unproductive, the formation structure of the binding line is very complicated, there may be a defect in the binding line of the guitar because the binding line is formed on the guitar in a separate type, and the separate type binding line may be frequently separated or damaged when the guitar is used for a long time.

CITED REFERENCES

Patent Documents

Korean Patent No. 10-0336707 granted on May 2, 2002

SUMMARY OF THE INVENTION

Accordingly, the present invention has been made in view of the above-mentioned problems occurring in the prior art, and it is an object of the present invention to provide a decorative panel for a guitar and a manufacturing method of the decorative panel, which can enhance productivity of guitars by simplifying the manufacturing processes and reducing the manufacturing period of time and can prevent a defective rate of a binding line and a damage of the binding line due to a long-term use of the guitar because the decorative panel, which is applied to a head, a body, a neck or a pick guard of the guitar, is manufactured by processing a base plate and the binding line disposed on the periphery of the decorative panel is formed integrally with the base plate.

To accomplish the above object, according to the present invention, there is provided a decorative panel for a guitar including: a base plate; and a binding disposed at the edge of the base plate in a band type by a binding line, which is integrally formed in such a way that one or more binding grooves formed on the periphery of the base plate (100) are filled with epoxy resin paint.

As described above, according to a preferred embodiment of the present invention, the decorative panel is manufactured through processing of the base plate and the binding which is formed in such a way that the periphery of the decorative panel is filled with epoxy resin is formed integrally with the decorative panel and is simplified in the processing processes of the decorative panel, such as processes of supplying plates, engraving the binding line, forming the binding line, cutting the outward appearance and grinding the surface, thereby enhancing productivity of guitars by remarkably reducing the binding forming process, reducing the defective rate and preventing damage of the decorative panel despite of a long-term use because of the integrally formed binding line.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
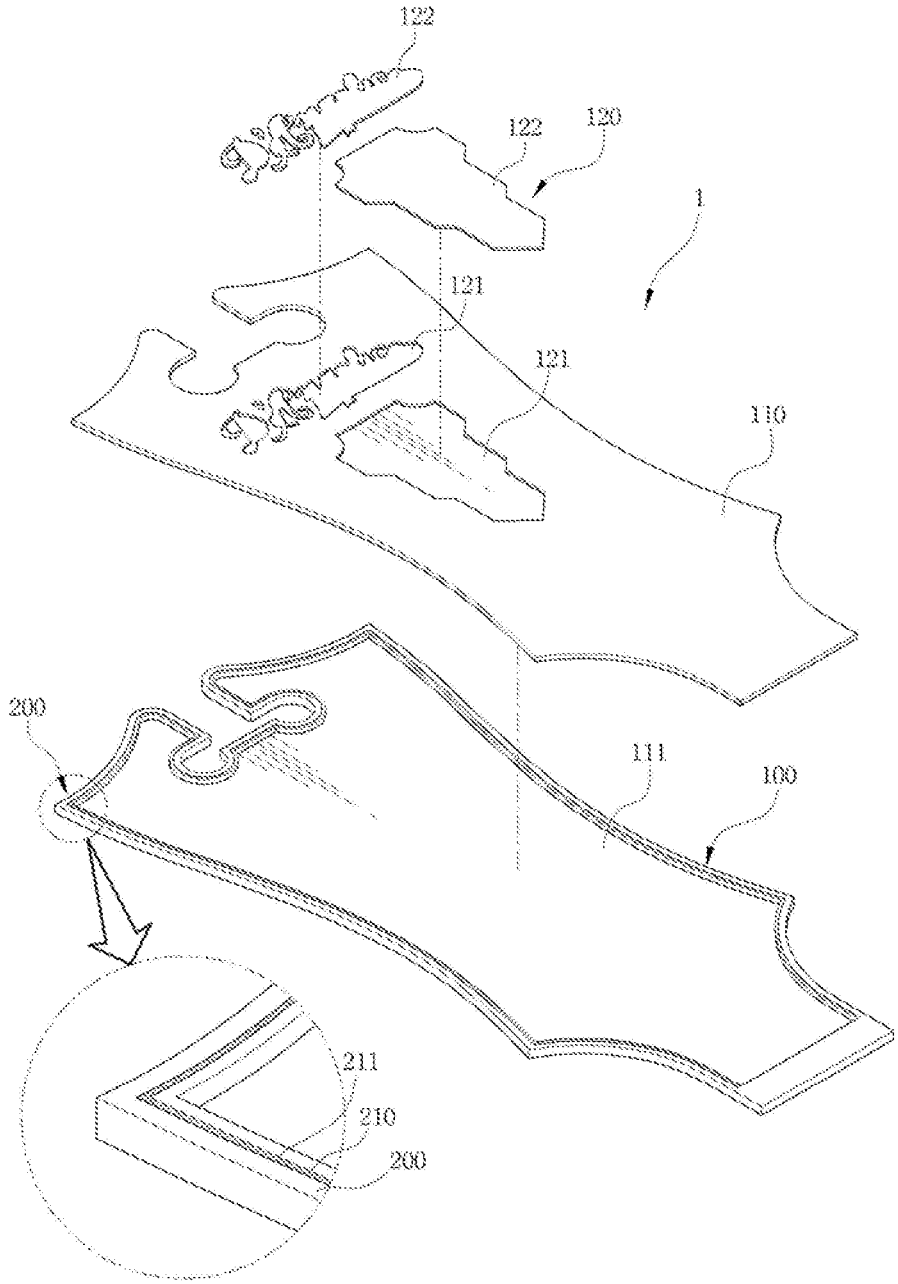
FIGS. 1 to 5 are views showing parts of a decorative panel for a guitar according to a preferred embodiment of the present invention.

Hereinafter, exemplary embodiments of a decorative panel for a guitar and a manufacturing method thereof according to the present invention will be described in detail with reference to accompanying drawings.

Meanwhile, in describing the embodiments of the present invention, detailed descriptions of components which are widely known in the relevant art to which the present invention belongs or does not belong will be omitted in order to make the substance of the present invention clear.

FIGS. 1 to 6 are views showing the decorative panel for the guitar and the manufacturing method of the decorative panel according to preferred embodiments of the present invention.

Now, the decorative panel 1 for the guitar will be described in brief. The decorative panel 1 includes a base plate 100; and a binding line 210 formed in such a way that a binding groove 211 is filled with epoxy resin so as to be formed integrally with the base plate 100.

Moreover, the manufacturing method of the decorative panel for the guitar includes: a supplying step (S10) of consecutively supplying a plurality of single plates 10; a engraving step (S20); a binding forming step (S30) of integrally forming the binding line 210; a cutting step (S40) of obtaining the base plate 100; and a finishing step (S50) of assembling the decorative panel 1.

Figure 2:
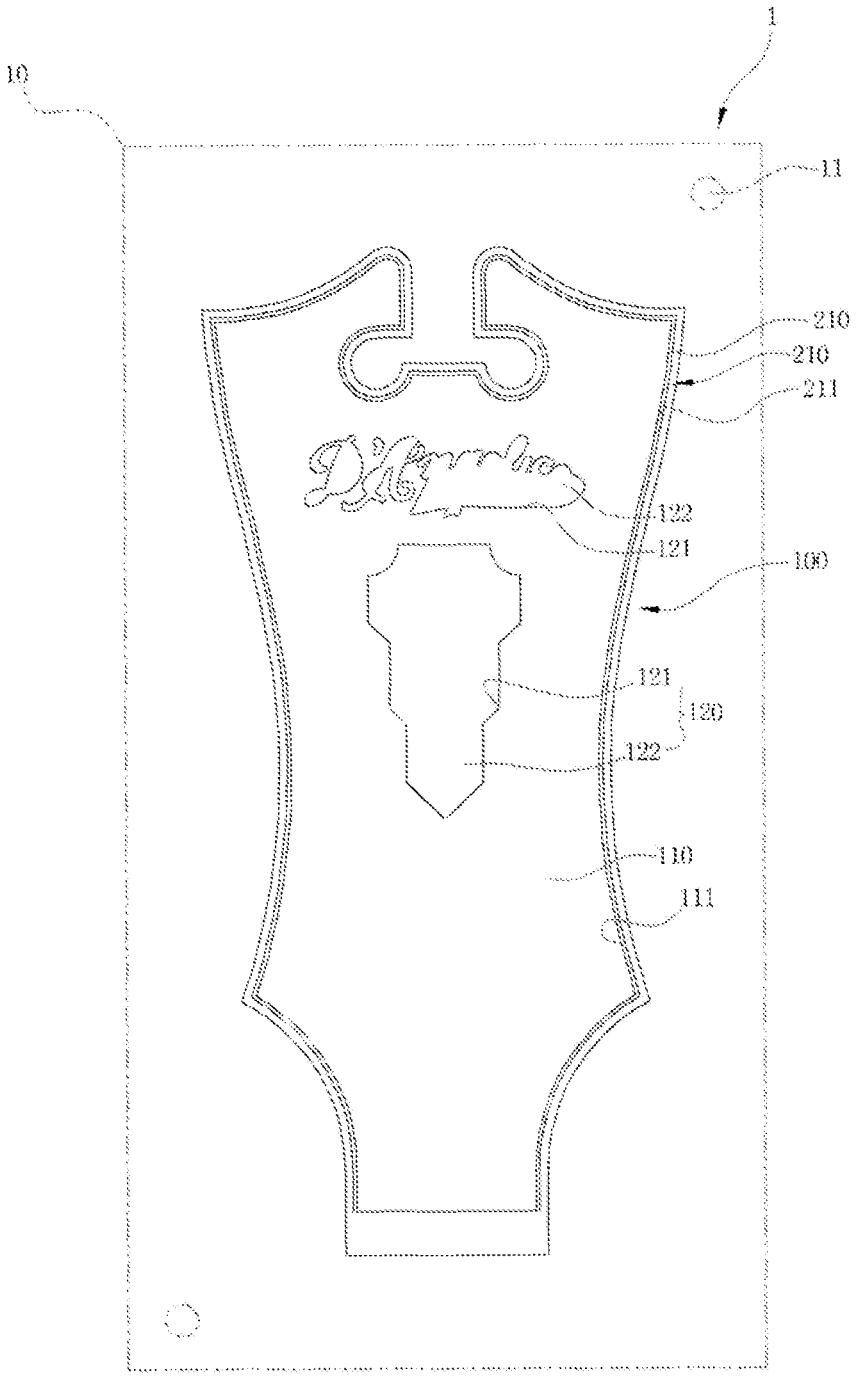
Figure 3:
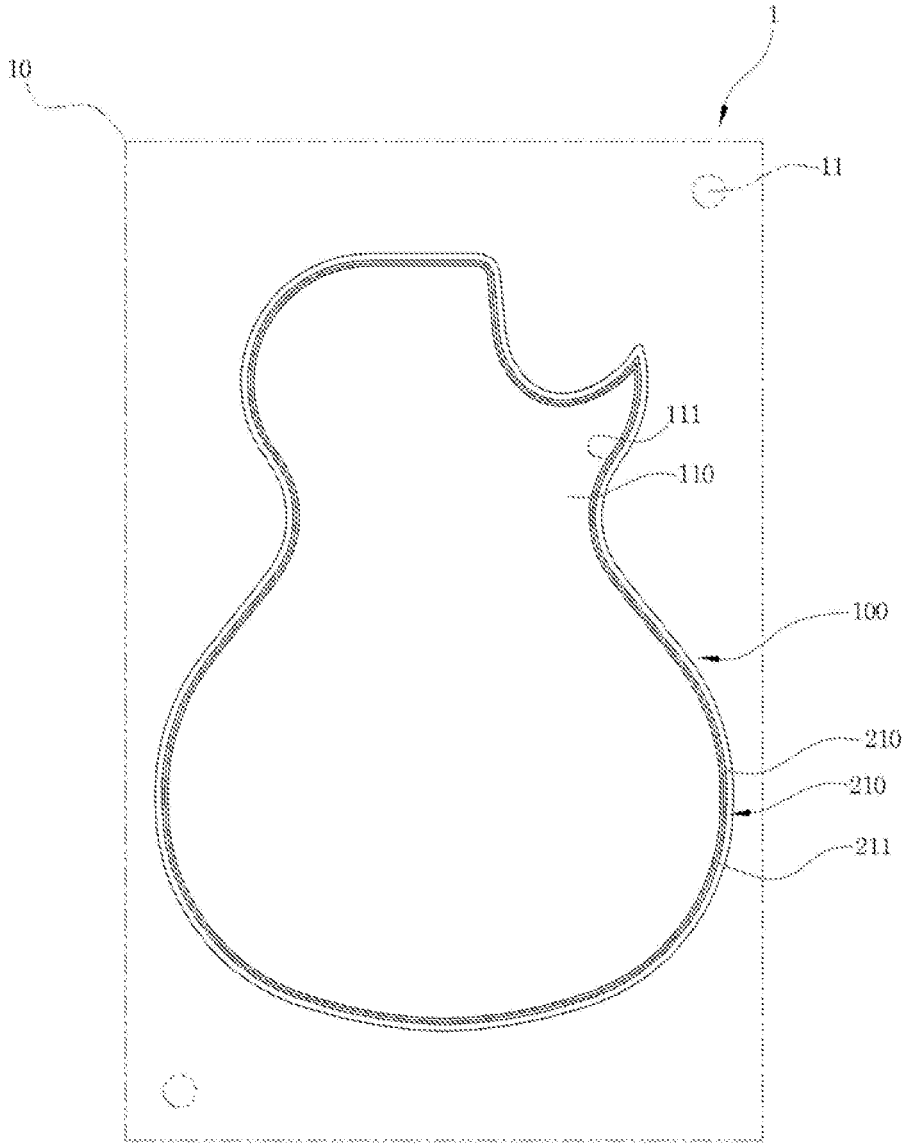
Figure 4:
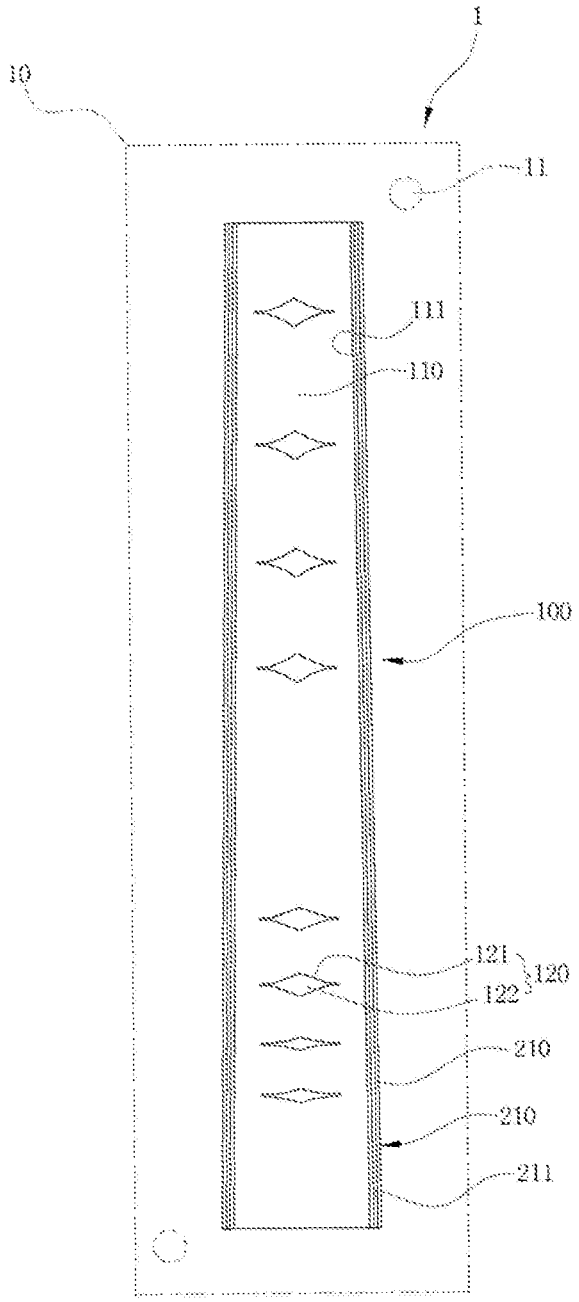
Figure 5:
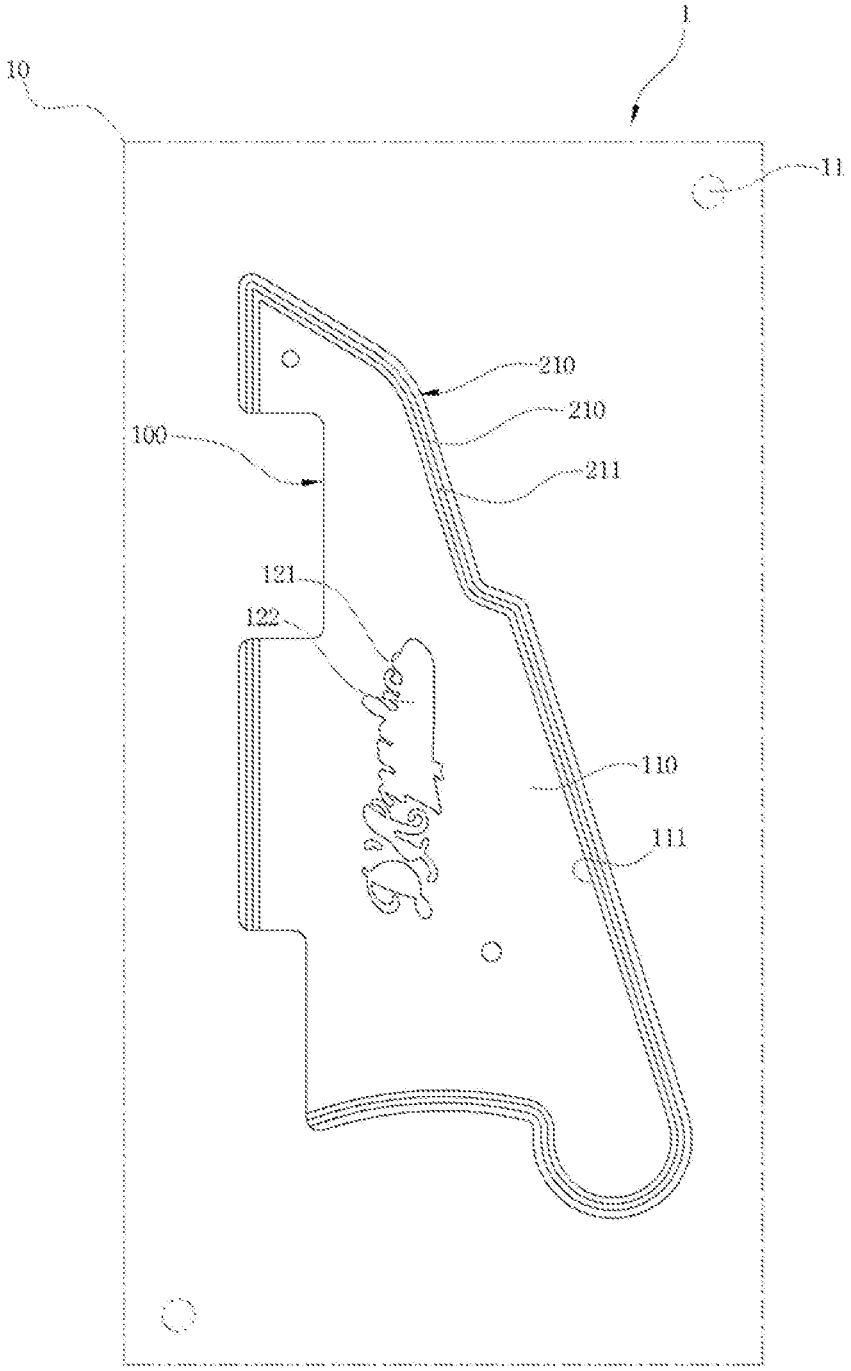

Hereinafter, referring to FIGS. 1 to 5, components of the decorative panel for the guitar according to a preferred embodiment of the present invention will be described in detail. FIG. 1 is an exploded perspective view of the decorative panel applied to a head of a guitar according to the preferred embodiment of the present invention, FIG. 2 is a view showing a state where the decorative panel is applied to the head of the guitar, FIG. 3 is a view showing a state where the decorative panel is applied to a body of the guitar, FIG. 4 is a view showing a state where the decorative panel is applied to a neck of the guitar, and FIG. 5 is a view showing a state where the decorative panel is applied to a pick guard of the guitar.

First, the base plate 100 is manufactured in the same form corresponding to the appearance of the head, the body, the neck or the pick guard of the guitar, and is a base to which various design elements of the decorative panel 1 will be applied.

The base plate 100 is made of wood or synthetic resin with durability, preferably, ABS (Acrylonitrile butadiene styrene copolymer) resin, and has the color corresponding to various colors of guitars. Preferably, the base plate 100 is made of ABS resin with ivory color, and if necessary, the surface of the base plate 100 may be painted with various colors.

In this instance, the base plate 100 is formed in such a way that a single plate 10 of a rectangular plate type is cut and processed corresponding to various forms of the head, the body, the neck or the pick guard of the guitar, and it makes mass production of the base plate 100 possible because the single plates 10 are consecutively supplied to an automated production line.

The base plate 100 according to the preferred embodiment of the present invention may further include a foundation plate 110.

For instance, the base plate 100 has a foundation recess 111 formed at a zone excepting the binding line 210, and the foundation plate 110 is inserted and adhered into the foundation recess 111 to provide a foundation surface of the guitar.

The foundation plate 110 is a plate made of ABS (Acrylonitrile Butadiene Styrene copolymer) resin and is the inner surface of the base plate 100, which is made corresponding to the form and depth of the foundation recess 111 formed at the zone excepting the binding line 210.

In this instance, the foundation plate 110 basically has a black color, but may be manufactured in various colors according to colors of guitars and users' selection.

In addition, the foundation plate 110 according to the basic embodiment of the present invention selectively include an ornament 120.

For instance, the ornament 120 of the foundation plate 110 is formed in such a way that one or more ornament recesses 121 are engraved on the inner surface of the foundation plate 110 and a pattern 122, which is formed in the shape of trademarks, images, letters or numbers applied to the guitar, is inserted and inlayed into the ornament recess 121 with an adhesive.

The ornament 120 includes the ornament recess 121 and the pattern 122, and the pattern is made with mother-of-pearl including artificial mother-of-pearl and is engraved in the shape of trademarks, images, letters or numbers applied to various kinds of guitars. The ornament recess 121 is formed at a predetermined location of the foundation plate 110 to have the same form and thickness as the pattern 122.

In this instance, preferably, the ornament 120 is selectively disposed on the head or the body of the guitar, but may be applied to the neck or the pick guard of the guitar according to the user's or buyer's taste. Screen printing is applied to the surface of the pattern 122 in correspondence with the marks, images, letters or numbers in order to provide a more accurate form.

Furthermore, the binding 200 is formed in a band type at the edge of the base plate 100 by the binding line 210, which is integrally formed in such a way that the one or more binding grooves 211 formed on the periphery of the base plate 100 are filled with epoxy resin paint, in order to provide a design element of the guitar.

Such a binding 200 is formed in a band type at the edge of the base plate 100 by the binding line 210, which is integrally formed in such a way that the binding groove 211 is filled with epoxy resin paint with chemical resistance and weather resistance. The epoxy resin paint is hardened while passing through the drying process so that the binding 200 is integrally formed not to be easily separated from the base plate 100.

Moreover, the binding groove 211 which is located at the outermost edge of the base plate 100 is formed to have an interval of 1 mm to 2 mm from the peripheral end of the base plate 100. The binding grooves 211 are formed at an interval of 0.4 mm to 0.6 mm from each other, are 0.4 mm to 0.6 mm in width, and has the depth within the scope not to penetrate the base plate 100.

Furthermore, the binding line 210 is formed in such a way that the binding groove 211 is filled with epoxy resin paint, and the epoxy resin paint is basically black, but may have various colors according to colors applied to various guitars or the user's selection.

Therefore, the binding is disposed at the edge of the base plate 100 in the same outward appearance as the conventional separate type binding for guitars due to the one or more binding lines 210.

Figure 6:
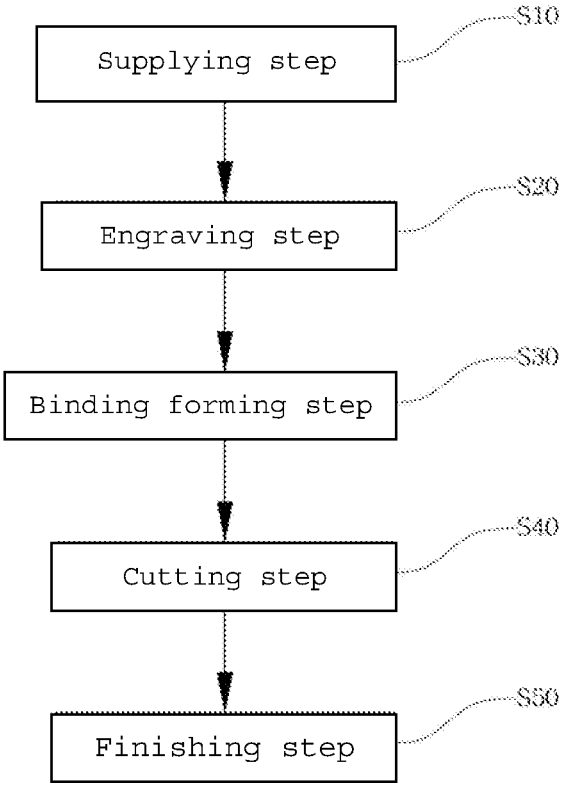
FIG. 6 is a flow chart showing a manufacturing method of the decorative panel for a guitar according to a preferred embodiment of the present invention.

In the meantime, referring to FIG. 6, the manufacturing method of the decorative panel for a guitar according to the preferred embodiment of the present invention will be described in detail. FIG. 6 is a flow chart showing the manufacturing method of the decorative panel for the guitar according to a preferred embodiment of the present invention.

First, the supplying step S10 is a process for consecutively supplying a plurality of single plates 10 in an automated production line.

The supplying step S10 is to automatically and consecutively supply the single plates 10 of the rectangular plate type made of ABS resin using conveying means, such as a conveyer.

In this instance, the single plate 10 has pilot pin holes 11 formed at one or more edges so as to be located at correct process positions, and pins for the processes are inserted and fixed into the pilot pin holes 11 so that the single plate 10 can be fixed at the correct position.

Additionally, the engraving step S20 is a process of forming one or more binding grooves 211, which have the outward appearance corresponding to the outward appearance of the head, the body, the neck or the pick guard of the guitar, on the inner surface of the single plates 10 consecutively supplied.

In the engraving step S20, the binding groove 211 having the width of 0.4 mm to 0.6 mm is formed on the inner surface of the single plate 10 corresponding to the outward appearances of the heads, the bodies, the necks or the pick guards of the guitars of various kinds when the single plates 10 consecutively conveyed and supplied are fixed at the correct positions for processing grooves using the pilot pin holes 11.

In this instance, the binding groove 211 which is located at the outermost edge of the base plate 100 is formed to have an interval of 1 mm to 2 mm from the peripheral end of the base plate 100, and the other binding grooves 211 are formed at an interval of 0.4 mm to 0.6 mm from each other.

The engraving step S20 according to the preferred embodiment may further include a foundation forming process.

For instance, in the engraving step S20, the foundation forming process of inserting and adhering the foundation plate 110, which is the foundation of the guitar, into the foundation recess 111 formed at the inner part of the binding groove 211 may be carried out.

In the foundation forming process, the foundation of the decorative panel 1 is formed in such a way that the foundation plate 110 formed in the same appearance and depth as the foundation recess 111 and made of ABS resin is inserted and adhered into the foundation recess 111, which is formed in a predetermined depth at the inner part excepting the binding groove 211.

In this instance, the foundation plate 110 may have various colors according to colors applied to guitars and the user's selection.

In addition, the foundation forming process may selectively include an ornament forming process.

For instance, in the foundation forming process, the ornament forming process of inlaying the ornament 120 has the steps of engraving one or more ornament recesses 121 on the inner surface of the foundation plate 110 and inserting and adhering the pattern 122, which is made in the form of trademarks, images, letter or numbers applied to the guitar, into the ornament recesses 121.

In the ornament forming process, when the ornament recess 121 is formed at the predetermined position of the foundation plate 110 in the same appearance, thickness and depth as the pattern 122 using a tool of 10 to 20, the pattern 122 which is made with mother-of-pearl including artificial mother-of-pearl and engraved in the shape of trademarks, images, letters or numbers applied to various kinds of guitars is inserted into the ornament recess 121, such that the ornament 120 is formed.

In this instance, screen printing corresponding to the trademarks, images, letters or numbers is applied to the surface of the pattern 122 in order to provide a more accurate form. Because the manufacturing method of such a mother-of-pearl has been widely known, its detailed description will be omitted.

Moreover, preferably, the ornament 120 is selectively disposed on the head or the body of the guitar, but may be applied to the neck or the pick guard according to the user's or buyer's taste.

Furthermore, the binding forming step S30 is the process of forming the binding 200 on the single plate 10 by filling the binding groove 211 formed on the single plate 10 with epoxy resin paint so as to integrally form the binding line 210.

In the binding forming step S30, when the single plates 10 having the binding grooves 211 are consecutively conveyed, the single plates are fixed at the correct working position of a printing machine using the pilot pin holes 11, and epoxy resin paint of various colors, preferably, a black color, is painted on the inner surface of the binding groove 211 to form the binding line 210, so that the binding 200 which is discriminable with naked eyes is formed on the peripheral portion of the binding line 210.

In this instance, when the binding groove 211 is filled with the epoxy resin paint to form the binding line 210, a drying process to dry and harden the binding line 210 at proper temperature with hot air or heat in a drying room is carried out.

Moreover, the cutting step S40 is the process of obtain the base plate 100 by cutting the edge portion of the binding 200 in the same appearance of the head, the body, the neck or the pick guard of the guitar.

When the single plate 10 having the binding 200 is supplied, the edge portion of the binding 200 is cut in the same way as the appearance of the head, the body, the neck or the pick guard of the guitar to obtain the base plate 100.

In the cutting step S40, when the single plates 10 having the bindings 200 are consecutively conveyed, the single plates 10 are fixed at the correct working positions of a cutting machine using the pilot pin holes 11, and then the edge periphery on which the binding 200 is formed is cut using the tool of 10 to 20 so as to obtain the base plate 100.

Moreover, the finishing step S50 is the process of adhering and assembling the decorative panel 1 on the front surface of the head, the body, the neck or the pick guard of the guitar when the base plate 100 is finished into the decorative panel 1.

The decorative panel 1 finished in the finishing step S50 is adhered on the front surface of the corresponding head, the body, the neck or the pick guard of the guitar with an adhesive so as to provide a design element to the guitar.

The finishing step S50 according to the preferred embodiment of the present invention includes a grinding process.

For instance, in the finishing step S50, the grinding process of providing a soft surface and gloss by grinding the surface of the finished decorative panel 1 is carried out.

In the grinding process, transparent poly coat is coated on the surface of the decorative panel 1 twice, and then, is hardened and ground with a grinding machine so as to make the surface of the decorative panel 1 flat and soft. After that, the surface of the decorative panel 1 is ground several times using the grinding machine so that the surface of the decorative panel 1 polishes.

Because the decorative panel 1 is manufactured through processing of the base plate 100 and the binding 200 which is formed in such a way that the periphery of the decorative panel 1 is filled with epoxy resin is formed integrally with the decorative panel 1 and is simplified in the processing processes of the decorative panel 1, thereby enhancing productivity of guitars by remarkably reducing the binding forming process, reducing the defective rate and preventing damage of the decorative panel despite of a long-term use because of the integrally formed binding line.

As described above, while the present invention has been particularly shown and described with reference to the example embodiments thereof, it will be understood by those of ordinary skill in the art that the terms used in the present invention are to easily describe the present invention but is not to limit the meanings of the terms or the scope of the present invention described in the claims.

Therefore, it will be also understood by those skilled in the art that various modifications, changes and equivalences may be made without departing from the scope and spirit of the present invention.

The invention claimed is:

1. A decorative panel for a guitar comprising:

a base plate; and a binding disposed at the edge of the base plate in a band type by a binding line which is integrally formed such that one or more binding grooves formed on a periphery of the base plate are filled with an epoxy resin paint.

2. The decorative panel according to claim 1, wherein the decorative panel is manufactured in a form corresponding to an outward appearance of a head, a body, a neck or a pick guard of the guitar, and wherein the base plate is adhered on a front surface of the head, the body, the neck or the pick guard of the guitar.

3. The decorative panel according to claim 1, wherein the base plate further comprises a foundation plate which is inserted and adhered into a foundation recess formed at a zone excepting the binding line to provide a foundation surface of the guitar.

4. A manufacturing method of a decorative panel for a guitar comprising:

a supplying step of consecutively supplying a plurality of single plates in an automated production line;

an engraving step of forming one or more binding grooves, which have a shape corresponding to an outward appearance of a head, a body, a neck or a pick guard of the guitar, on inner surfaces of the single plates consecutively supplied;

a binding forming step of integrally forming a binding line such that the one or more binding grooves formed on each single plate are filled with an epoxy resin paint, and forming a binding on said each single plate;

a cutting step of cutting an edge portion of the binding to have a same shape as the outward appearance of the head, the body, the neck or the pick guard of the guitar to obtain a base plate when said each single plate on which the binding is formed is supplied; and a finishing step of adhering and assembling the base plate onto the front surface of the head, the body, the neck or the pick guard of the guitar to provide the decorative panel for the guitar.

* * * * *